US011706561B1

(12) United States Patent
Varanda et al.

(10) Patent No.: US 11,706,561 B1
(45) Date of Patent: Jul. 18, 2023

(54) BALANCED ARMATURE RECEIVER WITH LIQUID-RESISTANT PRESSURE RELIEF VENT

(71) Applicant: Knowles Electronics, LLC, Itasca, IL (US)

(72) Inventors: Brenno Varanda, Hoffman Estates, IL (US); Chris Monti, Elgin, IL (US); Steve Kearey, Carpentersville, IL (US); Donald Verghese Jacob, Chicago, IL (US); Tim Wickstrom, Elk Grove Village, IL (US); Jose Salazar, Chicago, IL (US); Alex Grossman, Schaumburg, IL (US); Matt Manley, Itasca, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 17/561,691

(22) Filed: Dec. 23, 2021

(51) Int. Cl.
*H04R 1/28* (2006.01)
*H04R 11/02* (2006.01)

(52) U.S. Cl.
CPC ..... *H04R 1/2823* (2013.01); *H04R 11/02* (2013.01); *H04R 2460/11* (2013.01)

(58) Field of Classification Search
CPC .... H04R 1/2823; H04R 11/02; H04R 2460/11
See application file for complete search history.

(56) References Cited

U.S. PATENT DOCUMENTS

| | | | |
|---|---|---|---|
| 7,242,089 | B2 | 7/2007 | Minervini |
| 8,532,323 | B2 | 9/2013 | Wickstrom et al. |
| 8,983,105 | B2 | 3/2015 | Reining |
| 9,078,063 | B2 | 7/2015 | Loeppert et al. |
| 9,078,064 | B2 | 7/2015 | Wickstrom et al. |
| 9,374,643 | B2 | 6/2016 | Szczech et al. |
| 9,451,349 | B2 | 9/2016 | Wickstrom et al. |
| 9,479,854 | B2 | 10/2016 | Loeppert et al. |
| 9,794,661 | B2 | 10/2017 | Watson et al. |
| 10,291,973 | B2 | 5/2019 | Lim et al. |
| 10,433,071 | B2 | 10/2019 | Pal et al. |
| 10,591,326 | B2 | 3/2020 | Lim et al. |

(Continued)

FOREIGN PATENT DOCUMENTS

| | | |
|---|---|---|
| CN | 204206444 U | 3/2015 |
| CN | 205510405 U | 8/2016 |

(Continued)

OTHER PUBLICATIONS

Hangzhou IPRO Membrane Technology Co., Ltd., IPRO Venting & Protection, Technical Datasheet, AOEDPF-B002H.

(Continued)

*Primary Examiner* — Sunita Joshi
(74) *Attorney, Agent, or Firm* — Loppnow & Chapa

(57) ABSTRACT

A balanced armature receiver includes a gas permeable barrier located on a portion of the receiver defining a back volume to provide barometric relief. The barrier can be located in a wall portion or diaphragm of the receiver to vent the back volume to an exterior of the receiver directly, via a front volume, or via a nozzle. The gas permeable barrier is impermeable to liquid infiltration and can be configured to influence the low frequency response of the receiver.

20 Claims, 8 Drawing Sheets

(56) References Cited

U.S. PATENT DOCUMENTS

| | | | | |
|---|---|---|---|---|
| 10,654,712 | B2 | 5/2020 | Albers et al. | |
| 10,820,083 | B2 | 10/2020 | Szczech et al. | |
| 11,206,494 | B2 | 12/2021 | Lee et al. | |
| 2003/0085070 | A1 | 5/2003 | Wickstrom | |
| 2016/0066095 | A1 | 3/2016 | Szczech et al. | |
| 2016/0071506 | A1 | 3/2016 | Qutub et al. | |
| 2019/0208303 | A1* | 7/2019 | Monti | H04R 25/656 |
| 2019/0335262 | A1* | 10/2019 | Szczech | H04R 1/083 |
| 2020/0239301 | A1 | 7/2020 | Albers et al. | |
| 2022/0150609 | A1 | 5/2022 | Albers | |

FOREIGN PATENT DOCUMENTS

| | | | |
|---|---|---|---|
| CN | 205596269 | U | 9/2016 |
| CN | 206100379 | U | 4/2017 |
| CN | 20636504 | U | 7/2017 |
| CN | 206365041 | U | 7/2017 |
| WO | 1995021512 | A1 | 8/1995 |
| WO | 2017083626 | A1 | 5/2017 |
| WO | 2020210134 | A1 | 10/2020 |

OTHER PUBLICATIONS

Hangzhou IPRO Membrane Technology Co., Ltd., IPRO Venting & Protection, Technical Datasheet, AOEPF-03F.
Hangzhou IPRO Membrane Technology Co., Ltd., IPRO Venting & Protection, Technical Datasheet, DPF-B002H.
Hangzhou IPRO Membrane Technology Co., Ltd., IPRO Venting & Protection, Technical Datasheet, PF-03F.
Hangzhou IPRO Membrane Technology Co., Ltd., IPRO Venting & Protection, Technical Datasheet, PF-5THV.
Hangzhou IPRO Membrane Technology Co., Ltd., IPRO Venting & Protection, Technical Datasheet, AOEAP-1.
Hangzhou IPRO Membrane Technology Co., Ltd., IPRO Venting & Protection, Technical Datasheet, AOEPF-5THV.
Hangzhou IPRO Membrane Technology Co., Ltd., IPRO Venting & Protection, Technical Datasheet, AP-1.
Hangzhou IPRO Membrane Technology Co., Ltd., IPRO Venting & Protection, Technical Datasheet, PF-RBH10H.

* cited by examiner

BALANCED ARMATURE RECEIVER WITH LIQUID-RESISTANT PRESSURE RELIEF VENT

FIELD OF THE DISCLOSURE

The present disclosure relates generally to balanced armature receivers and more particularly to balanced armature receivers having a barometric relief vent with improved resistance to liquid ingress.

BACKGROUND

Balanced armature receivers (also referred to herein as "receivers") capable of producing an acoustic output signal in response to an electrical audio signal are commonly used in receiver-in-canal (RIC) hearing aids, wired and wireless earphones, True Wireless Stereo (TWS) devices, among other hearing devices. Such receivers generally comprise a diaphragm disposed in a housing, also called a case, which separates the interior into a front volume and a back volume. A motor located in the housing actuates a portion of the diaphragm, known as a paddle, to emit sound from a sound port acoustically coupled to the front volume. The motor generally comprises a coil disposed about an armature having a movable end-portion coupled to the paddle and balanced between permanent magnets retained by a yoke. The free-end portion of the armature oscillates between the magnets, thereby driving the paddle in response to an audio signal applied to the coil. Balanced armature receivers require an air path, known as a barometric relief vent, to equalize air pressure in the back volume with the ambient air pressure. In some receivers, the vent is a small pierce through the diaphragm between the front and back volumes. The vent can also be an aperture through the case venting the back volume directly to the exterior of the receiver. However these and other sound producing transducers are susceptible to damage by liquids that infiltrate the back volume via the barometric relief vent. There is increasing consumer demand for hearing devices that are resistant to liquid infiltration that can result from accidental and intentional exposure that may occur while bathing, swimming and during other activity.

BRIEF DESCRIPTION OF THE DRAWINGS

The objects, features and advantages of the present disclosure will become more fully apparent from the following detailed description and the appended claims considered in conjunction with the accompanying drawings. The drawings depict only representative embodiments and are therefore not considered to limit the scope of the disclosure.

Figure 1:
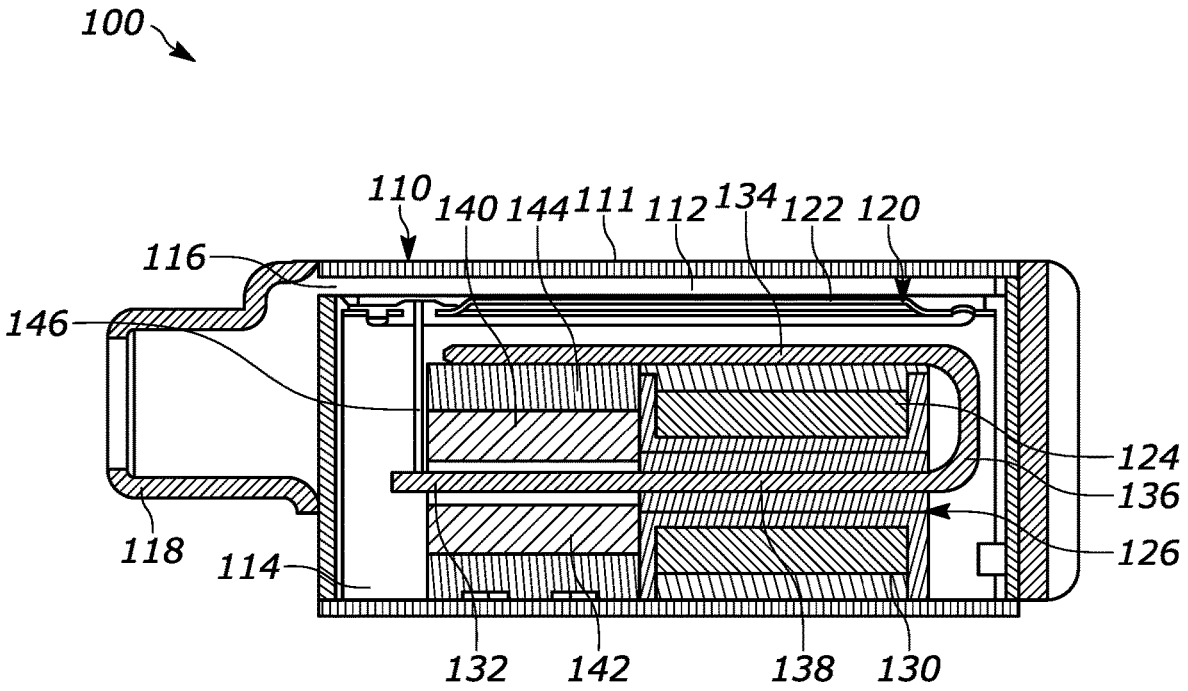
FIG. 1 is a sectional view of a balanced armature receiver that can include a gas permeable barrier as disclosed herein.

Those of ordinary skill in the art will appreciate that the figures are illustrated for simplicity and clarity and therefore may not be drawn to scale and may not include well-known features, that the order of occurrence of actions or steps may be different than the order described and that some actions or steps may be performed concurrently unless specified otherwise, and that the terms and expressions used herein have the meaning understood by those of ordinary skill in the art except where different meanings are attributed to them herein.

DETAILED DESCRIPTION

The disclosure relates generally to balanced armature receivers having improved resistance to liquid ingress and more particularly to balanced armature receivers having a barometric or pressure relief vent having improved liquid impermeability. Such a relief vent equalizes pressure between an interior and exterior of the receiver while providing a degree of liquid impermeability. Receivers are commonly used in receiver-in-canal (RIC) hearing aids, wired and wireless earphones, True Wireless Stereo (TWS) devices, among other hearing devices that may be exposed to liquid contaminants.

A balanced armature receiver generally comprises a housing having a sound port between an interior and exterior thereof, a diaphragm disposed in the housing and separating the interior thereof into a front volume and a back volume. A motor disposed at least partially within the housing comprises a coil located proximate an armature having a free-end portion that vibrates between permanent magnets retained by a yoke in response to application of an audio signal to the coil; otherwise the armature is balanced between the magnets. The free-end portion of the armature is coupled to a movable portion of the diaphragm that vibrates with the armature to produce sound emitted from the sound port.

According to one aspect of the disclosure, the receiver comprises a gas permeable barrier disposed on a portion of the receiver defining the back volume. The gas permeable barrier forms a barometric vent configured to provide barometric pressure relief for the back volume of the housing to accommodate changes in temperature or ambient pressure. Lack of pressure equilibrium in the back volume causes displacement of the reed, which can adversely affect performance of the receiver. Thus the barometric relief vent must have an appropriate amount of acoustic resistance to equalize pressure within a short amount of time, for example one second, to avoid acoustic artifacts that may be perceptible to the user. Generally, the acoustic resistance of the barometric relief vent is between about 5E9 Pa·s/m^3 to about 1E13 Pa·s/m^3. Acoustic resistance is determined by dividing the specific acoustic impedance of the barrier by the area of the vent aperture. MKS unit of specific acoustic impedance are Pa·s/m, also known as the MKS Rayl, or just Rayl. In receiver implementations where the barometric relief vent is formed by a barrier disposed over an aperture through the housing or through the diaphragm, the aperture can have a diameter between about 0.1 mm and 1.0 mm. In other implementations, the barometric relief vent can be more diffuse, i.e., spread over a relatively large surface area, representative examples of which are described herein.

According to another aspect of the disclosure, the gas permeable barrier is also substantially impermeable to liquids thereby preventing infiltration of liquids into the back volume. Substantially impermeable means that the barrier will prevent infiltration of liquids into the back volume for a specified equivalent water pressure and time duration. A common type of water pressure is static head pressure caused by the weight of water due to its height above an object. A balanced armature receiver submerged in water will be subject to such water pressure. Other types of water pressure are dynamic, where the water is moving and the water pressure is changing. Resistance to liquids in these and other environments is often defined by the Ingress Protection (IP) ratings of the International Electrotechnical Commission (IEC) 60529. For example, IPX5 specifies resistance to low-pressure water jet spray, IPX6 specifies resistance to high-pressure, heavy sprays of water, IPX7 specifies submergence up to 1 meter of water for 30 minutes, and IPX8 specifies submergence greater than 1 meter as specified by the manufacturer.

The barometric relief vent provides liquid impermeability via a long, compact, tortuous path through a hydrophobic barrier material. Such liquid impermeability is often related to the specific acoustic impedance characteristic of the barometric relief vent. A higher specific acoustic impedance will often provide greater liquid impermeability (i.e., impermeability at a greater water head pressure or for a longer duration) because the higher impedance tortuous path is also more impermeable to water penetration. Based on materials that are available today, a barometric relief vent having a specific acoustic impedance of at least 5,000 MKS Rayl may be required for liquid impermeability for 1 minute at 3 meters of water head pressure. A barometric relief vent having a specific acoustic impedance of at least 400,000 MKS Rayl may be required for liquid impermeability for 1 minute at 15 meters of water head pressure. A barometric relief vent having a specific acoustic impedance of at least 800,000 MKS Rayl may be required for liquid impermeability at 60 meters of water head pressure for 1 minute. Liquid impermeability for more or less head pressures and exposure durations will require more or less acoustic impedance accordingly.

In one implementation, the gas permeable barrier is an expanded polytetrafluoroethylene (ePTFE) material. Other gas permeable materials that are impermeable to liquids include Thermoplastic Polyurethane Films (TPFs), melt-blown fabrics, nanospun materials, among other materials. In principal, any known or future material or structure having small pores or tightly wound fabric are suitable for use as a gas permeable barrier provided the material has hydrophobic properties or is coated with a material having hydrophobic properties. In some implementations, the gas permeable barrier includes an oleophobic coating to reduce adhesion of grease, oils and other contaminants.

The gas permeable barrier can be a patch fixed over an aperture or opening in the housing. In one representative implementation the back volume is vented directly to an exterior of the housing. In another representative implementation, the gas permeable barrier is located between the back volume and the front volume (e.g., on a portion of the diaphragm) wherein the back volume is vented to the exterior of the housing via the front volume. In still another representative implementation, the gas permeable barrier is located between the back volume and a nozzle coupled to the sound port wherein the back volume is vented to an exterior of the housing via the nozzle. Combinations of these venting configurations are also contemplated by the disclosure. The entire receiver housing can be fabricated from a material that functions as the gas permeable barrier. A portion of the diaphragm can also be fabricated from the gas permeable barrier. Alternatively, the barrier can be a patch fixed over an aperture or opening in the diaphragm. The barrier can be on any wall portion of the housing, including either end wall portion, any sidewall portion, or top or bottom wall portions. The barrier can be located on an inner or outer surface of the housing wall portion. The precise location of the barrier can depend on how the receiver is mounted or integrated with the host device, e.g., wireless earphones, to ensure free flow of air to and from the housing interior and to avoid interference with other structures. Representative and non-limiting examples are described further herein with reference to the drawings.

FIG. 1 is a representative balanced armature receiver 100 in which a gas permeable barrier impermeable to liquids can be implemented as described further herein. Other suitable receivers can take other forms. The receiver 100 generally comprises a housing 110, a diaphragm 120 disposed within and separating an interior of the housing into a front volume 112 and a back volume 114. The front volume is acoustically coupled to an exterior of the housing via a sound port 116 located on an end wall portion. The representative receiver housing also includes a nozzle 118 disposed over the sound port 116 and coupled to the end wall portion on which the sound port is located. Other receivers do not include a nozzle. More generally, the sound port can be located on different portions of the housing. For example, the sound port can be located on a wall portion 111 parallel to the diaphragm and partially defining the front volume. Alternatively, the sound port can be on a wall portion defining another part of the front volume.

In FIG. 1, a motor disposed in the back volume comprises a coil 124 supported by a bobbin 126 located about an armature 130 having a free-end portion 132 movably located between permanent magnets 140, 142 retained in space apart relation by a yoke 144. The free-end portion of the armature is coupled to a movable portion of the diaphragm known as a paddle 122 by a drive rod or other link 146. The armature in FIG. 1 is a U-reed having a first arm 134 coupled to the yoke and a second arm 138 from which the free-end portion 132 extends. A U-portion 136 of the armature interconnects the first and second arms. Other receivers can have a variety of other forms. For example, the armature can be an E-reed or some other armature configuration, the coil need not be supported by a bobbin, and the motor can be located in the front volume instead of the back volume.

Figure 2:
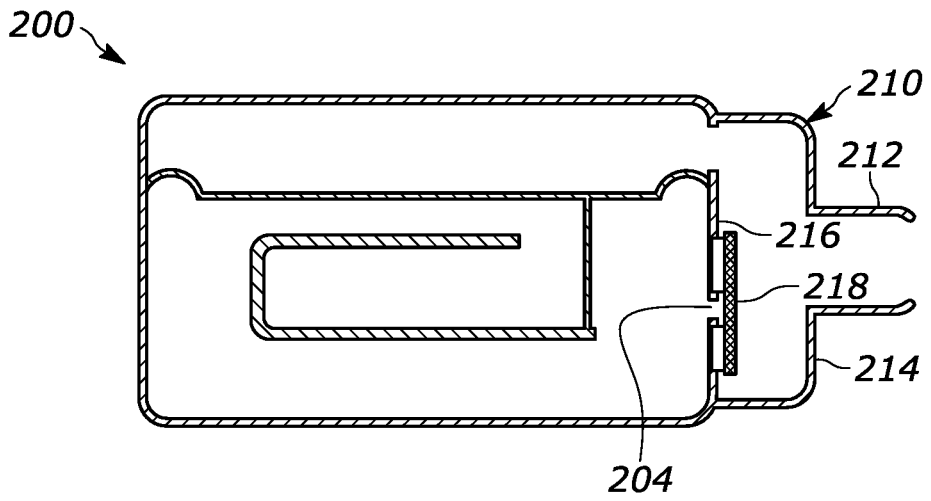
FIG. 2 is a sectional view of a receiver having a gas permeable barrier covered by a nozzle.
Figure 3:
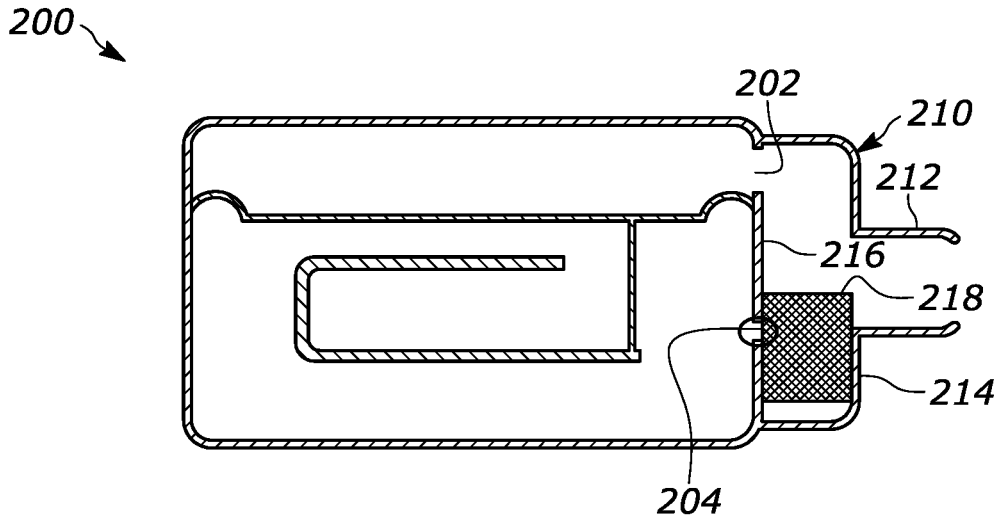
FIG. 3 is another sectional view of a receiver having a gas permeable barrier covered by a nozzle.

In receivers comprising a nozzle, the gas permeable barrier can be located between a portion of the nozzle and a wall portion of the case defining the back volume to which the nozzle is affixed. Locating the barrier between the nozzle and the wall portion simplifies assembly of the barrier, may not change the overall outer dimensions of the receiver, and provides a degree of protection to the barrier since it is not exposed. In FIGS. 2 and 3, the receiver 200 comprises a nozzle 210 acoustically coupled to a sound port 202 of the receiver. The nozzle comprises a sound tube portion 212 and a base portion 214 coupled to an end wall 216. The gas permeable barrier 218 is disposed on a portion of the end wall 216 covered by at least a portion of the nozzle 210. The barrier covers an aperture or opening 204 through the end wall. In FIG. 2, the barrier is fastened to the end wall 216 opposite the back volume with an adhesive or other fastening mechanism. In FIG. 3, the gas permeable barrier 218 is clamped between the end wall 216 and the base portion 214 of the nozzle.

Figure 4:
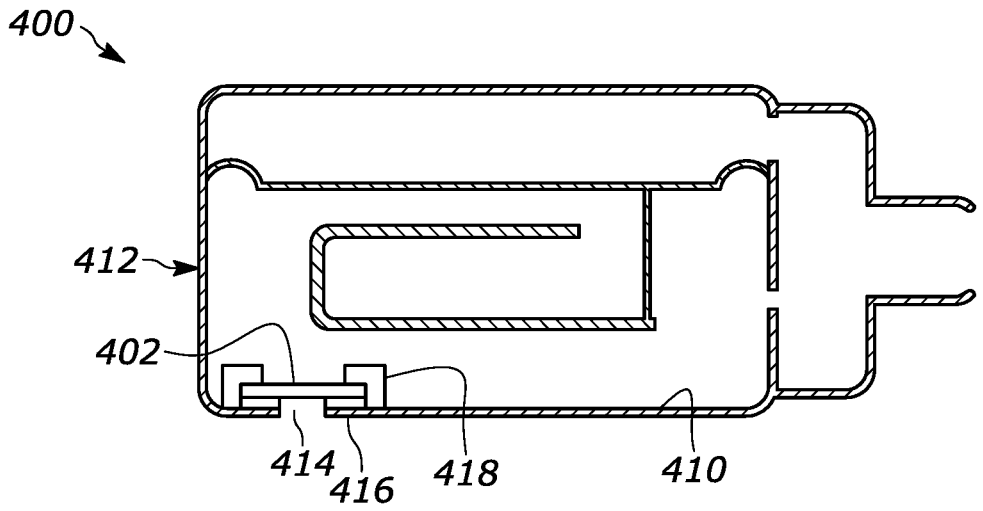
FIG. 4 is a sectional view of a receiver having a gas permeable barrier vented directly to an exterior of the housing.

In other implementations, the gas permeable barrier is disposed on an exterior wall portion defining the back volume wherein back volume is vented directly to an exterior of the housing. In the receiver 400 of FIGS. 4 and 5, the gas permeable barrier 402 is mounted on an inner surface 410 of an exterior wall portion of the housing 412. In FIG. 4, the barrier 402 covers an opening 414 through the exterior wall portion and can be affixed to the surface 410 by a glue or other fastening mechanism between the barrier and the surface. The glue may be a flat annular structure 146, such as a pressure sensitive adhesive (PSA) that sits between the barrier and the surface 410. Alternatively, the glue may go over and around the barrier in an annular form 418. The annular form may be formed from cured epoxy in one example. Alternatively, the barrier can be secured and/or sealed to the housing with both a flat annular structure 416 and an annular form 418.

Figure 5:
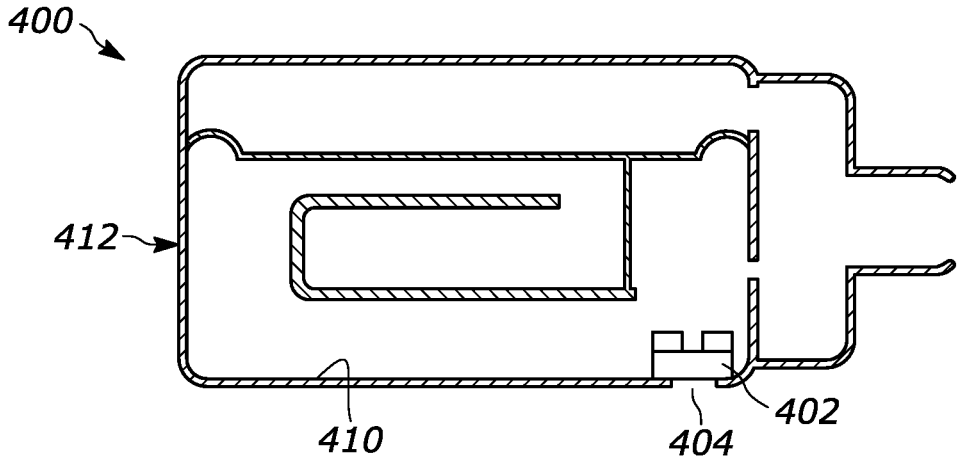
FIG. 5 is sectional view of a receiver having a clamp structure for retaining a gas permeable barrier within a receiver housing.
Figure 6:
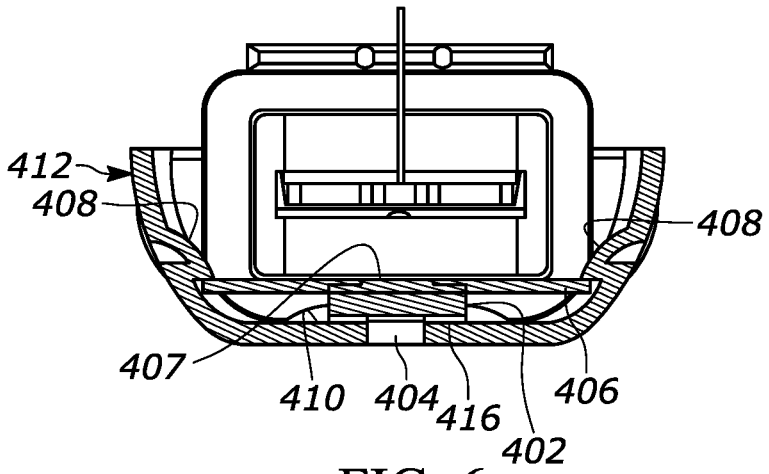
FIG. 6 is a more detailed view of a receiver having a clamp structure for retaining a gas permeable barrier within a receiver housing.
Figure 7:
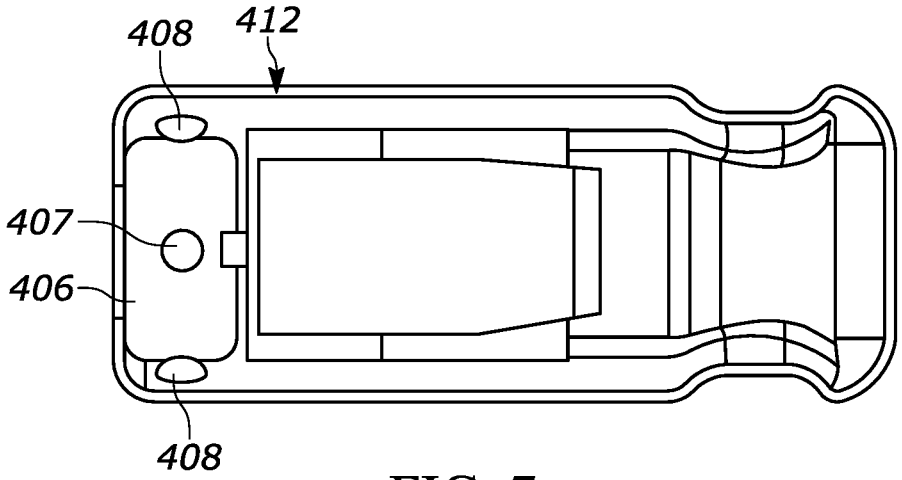
FIG. 7 is a different view of the clamp structure of FIG. 6.
Figure 8:
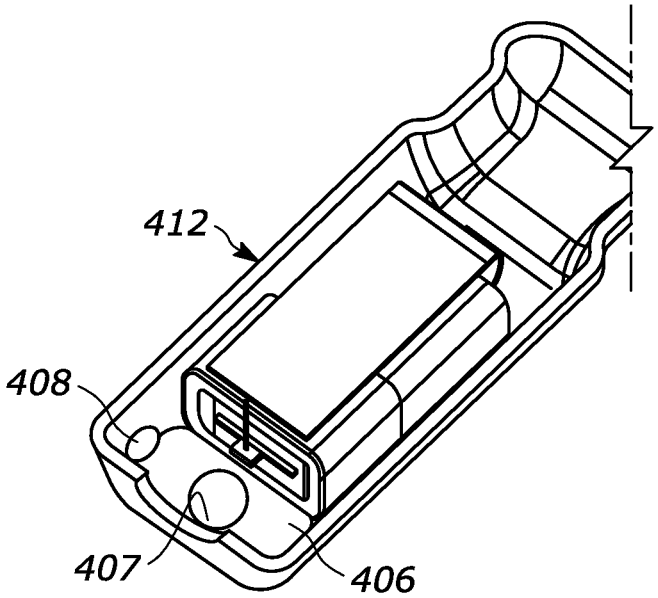
FIG. 8 is another view of the clamp structure of FIG. 6.

In FIG. 5, the barrier 402 covers an opening 404 through the exterior wall portion and is retained on the bottom surface 410 by a mechanical clamp. FIGS. 6-8 show various views of a representative clamping structure suitable for retaining the barrier on an inner surface of the exterior wall portion. In FIG. 6, the clamp comprises a retention plate 406 having an aperture 407 that applies a clamping force to a top of the barrier 402 positioned over the aperture 404 in the exterior wall portion of the housing. The clamping force retains the barrier against the inner surface 410 of the housing 412. In FIGS. 6-8, tabs 408 on opposite sidewall portions of the housing 412 retain the retention plate 406 in contact with the barrier. In some implementations, the retention plate can flex to snap fit beneath the tabs 408. The barrier can also be seated in a recess (not shown) formed in one or both of the retention plate or the bottom surface of the housing for location purposes. Optionally, the retention plate can be configured to apply sufficient force to position the barrier without the need for a recess. Alternatively, in FIG. 6 an adhesive layer 416, such as a pressure sensitive adhesive (PSA), can locate the barrier 402 and seal it to the inner surface 410.

Figure 9:
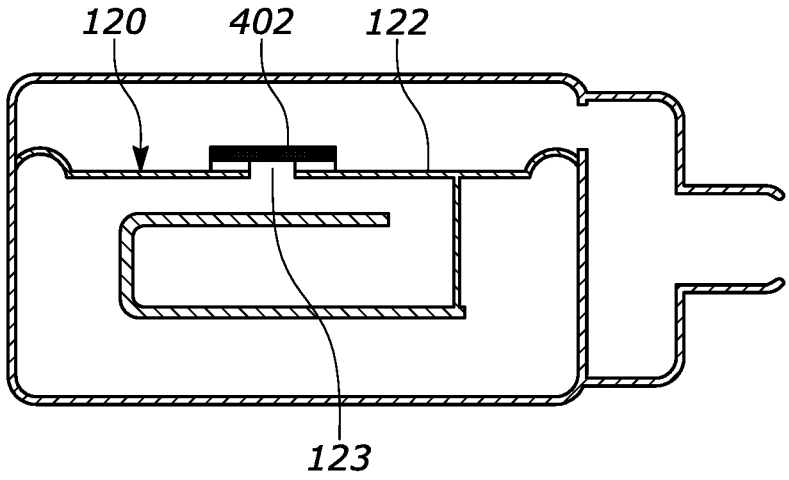
FIG. 9 is a sectional view of a receiver having a gas permeable barrier on a portion of a diaphragm.
Figure 10:
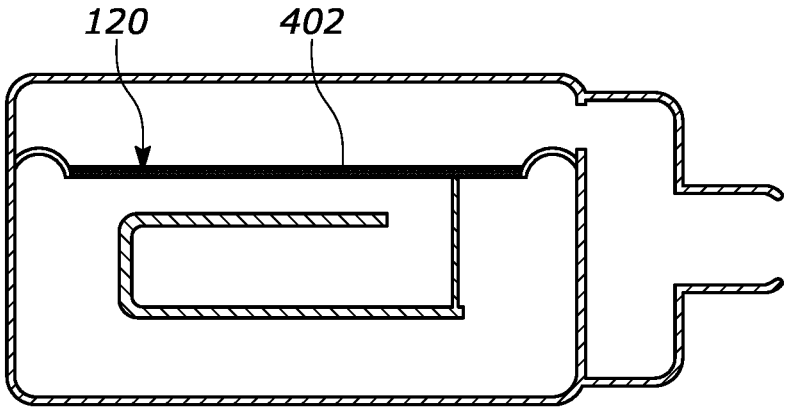
FIG. 10 is a sectional view of a receiver having a gas permeable barrier on another portion of a diaphragm.
Figure 11:
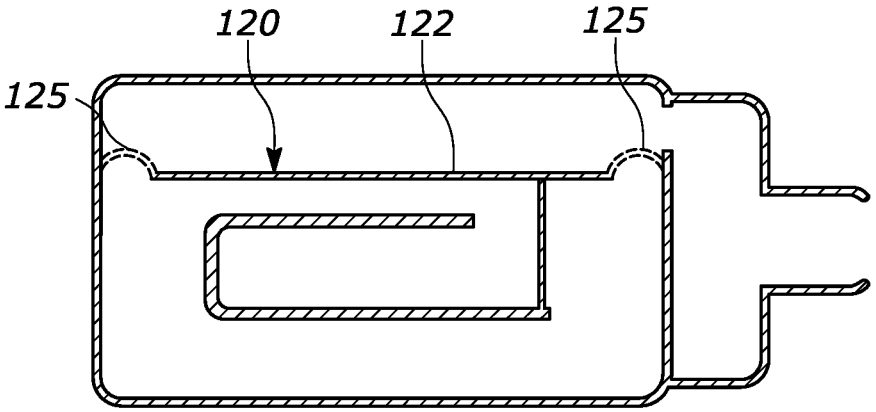
FIG. 11 is a sectional view of a receiver having a gas permeable barrier on yet another portion of a diaphragm.
Figure 12:
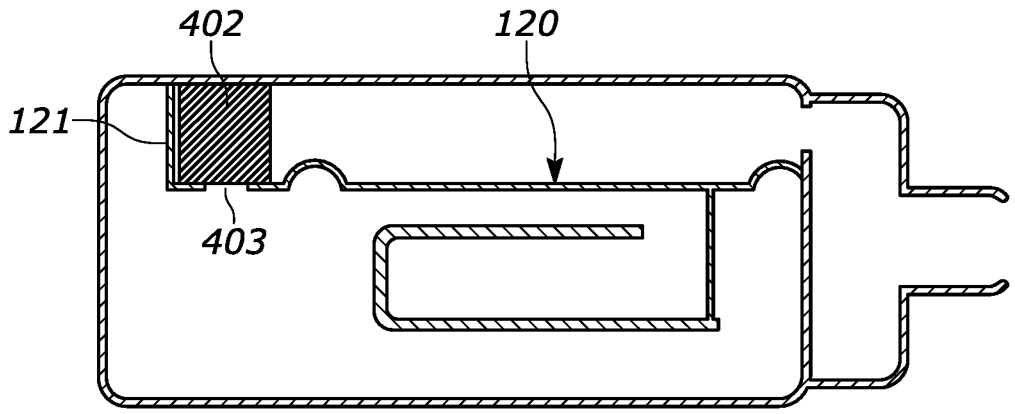
FIG. 12 is a sectional view of a receiver having a gas permeable barrier on still another portion of a diaphragm.

In other implementations, the gas permeable barrier is integrated with the diaphragm or constitutes a part of the diaphragm, wherein the back volume is vented to an exterior of the housing via the front volume. The diaphragm comprises a rigid paddle movably coupled to a frame by a flexible membrane covering a gap between the paddle and frame. In FIG. 9, the gas permeable barrier 402 is located on the paddle 122 of the diaphragm 120. The barrier covers an aperture 123 through the paddle 122 and can be affixed to the paddle by an adhesive or other fastening mechanism. In FIG. 10, the gas permeable barrier 402 constitutes all or a portion of the paddle. For example, the paddle can be fabricated from a rigid material that provides a liquid impermeable and gas permeable barrier. In FIG. 11, the gas permeable barrier constitutes the flexible membrane 125. In other words, the flexible membrane is fabricated from a material that provides a liquid impermeable and gas permeable barrier. For example, the flexible membrane can be fabricated from an ePTFE or other compliant material. In other implementations, the gas permeable barrier is located on or constitutes the frame of the diaphragm. In FIG. 12, the gas permeable barrier 402 is fixed to a portion of the frame 121 and the barrier covers an opening 403 in the frame. The barrier can be fixed to the frame by an adhesive or other fastening mechanism or the barrier can be retained by a portion of the frame. In other implementations, the barrier can be located on more than one portion of the diaphragm.

Figure 13:
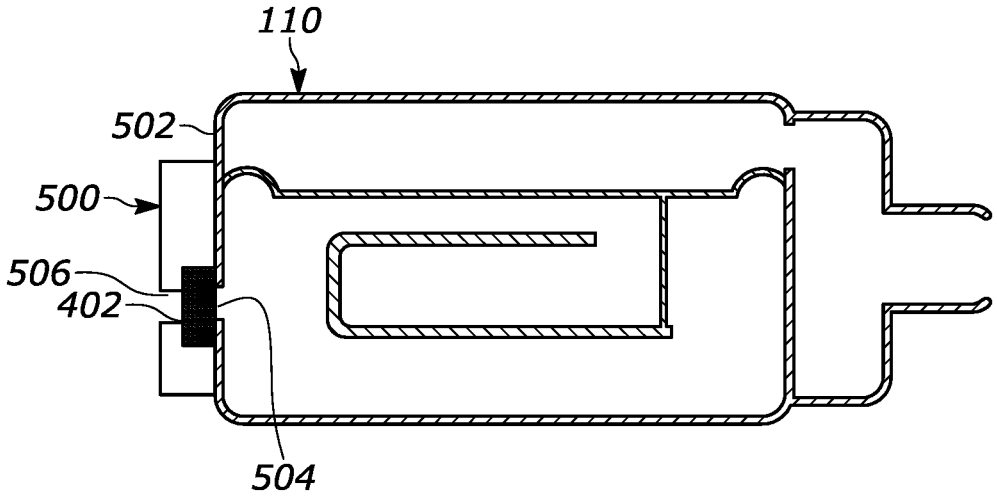
FIG. 13 is a sectional view of a receiver having a gas permeable barrier co-located with a terminal portion of a receiver.

Receivers generally comprise a terminal located on an outer portion or surface of the housing. The terminal includes contacts electrically coupled to the coil within the housing, wherein the contacts are accessible from an exterior of the receiver for receiving an audio signal applied to the coil. In some implementations, the gas permeable barrier is co-located with the terminal, wherein the back volume is vented to an exterior of the housing either through the terminal or in a vicinity of the terminal. The terminal can include an aperture aligned with an aperture through a wall portion of the housing so that the back volume is vented through the terminal. In FIG. 13, the receiver comprises a terminal 500 located on an outer surface of an end wall 502 of the housing 110. The terminal covers a gas permeable barrier 402 covering an opening 504 through the end wall. The opening in the end wall communicates with an opening 506 in the terminal. Alternatively, the barrier can be a patch affixed to an outer surface of the terminal over the opening 506.

The frequency response of the receiver depends generally on the location of the barometric relief vent and its acoustic resistance. The barometric relief vent can be located between back and front volumes of the receiver, or on an exterior wall of the back volume vented directly to an exterior of the receiver. For a barometric relief vent located between the front and back volumes, low frequencies are increasingly attenuated in the acoustic response of the receiver (i.e., will have a higher frequency roll off) with decreasing acoustic resistance and vice versa. Barometric relief vents that pass directly to an exterior of the receiver amplify low frequencies to some extent. Decreasing the acoustic resistance of vent that pass directly to the exterior of the housing will increase the frequency range where amplification occurs. Representative examples are described further herein.

Figure 14:
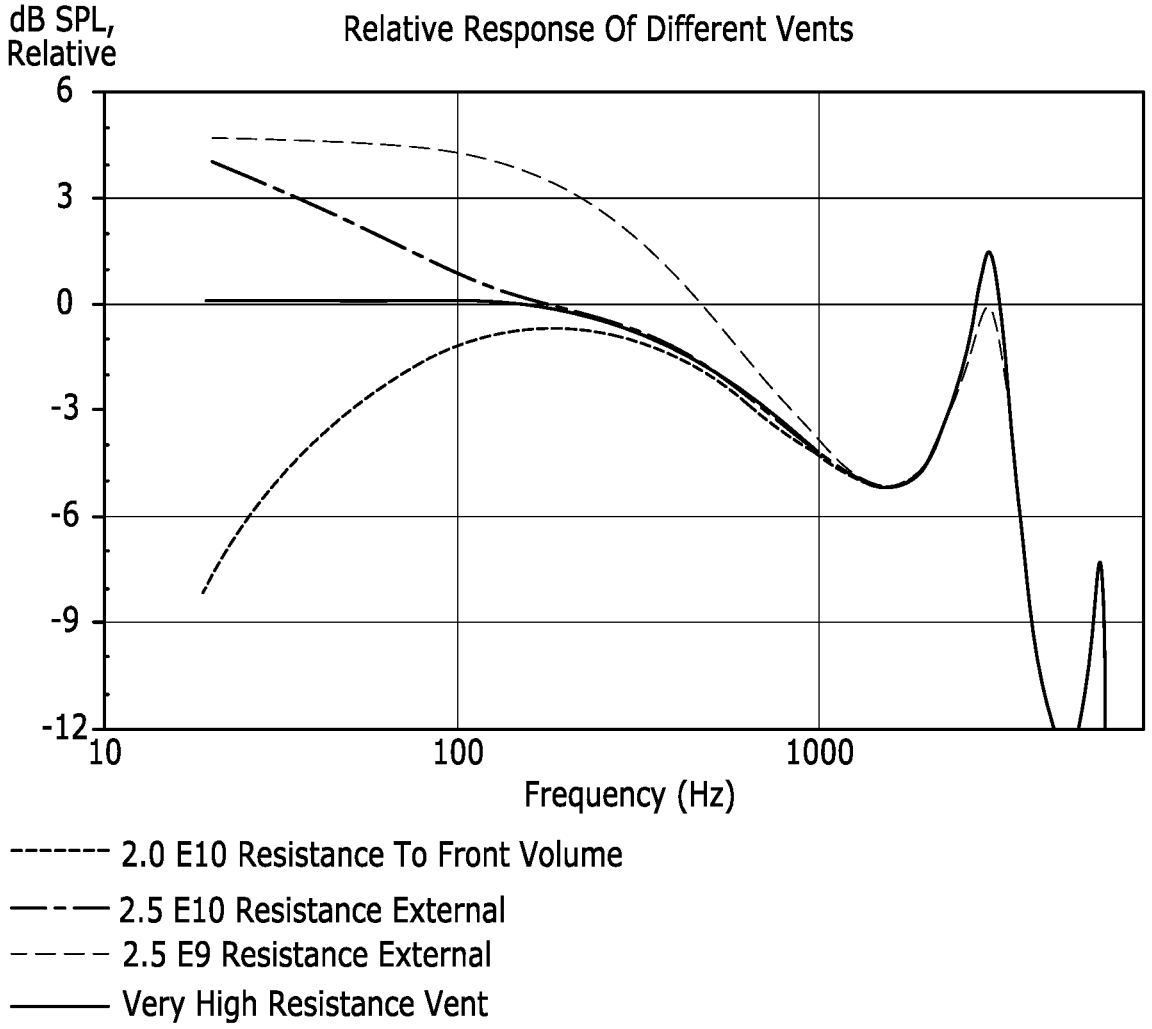
FIG. 14 are characteristic frequency response plots for receivers with and without a barometric relief vent.

In a first scenario shown in FIG. 14, the Very High Resistance Vent plot corresponds to a substantially blocked vent (i.e., virtually no barometric relief) and produces a relatively flat sound pressure level (SPL) at low frequencies. The Very High Resistance Vent plot represents the characteristic frequency response of the receiver. In a second scenario shown in FIG. 14, the 2.0E10 (Pa·s/m^3) Resistance to Front Volume plot corresponds to a vent between the back and front volumes (e.g., a vented diaphragm) and shows SPL attenuated at low frequencies. In this example, the frequency response shows a 3 dB drop at approximately 50 Hz compared to the characteristic frequency response. Reducing the acoustic resistance will increase the cutoff frequency the attenuation. The acoustic resistance depends on the aperture size and specific acoustic impedance of the barrier. In FIG. 14, the 2.5E10 (Pa·s/m^3) Resistance External plot corresponds to a back volume vented directly to the exterior of the housing and shows SPL increased at low frequencies due to reduced acoustic stiffness of the back volume. The acoustic stiffness of the back volume can be reduced at low frequencies by decreasing the acoustic resistance of the vent. In this example, the frequency response increases by 3 dB at approximately 35 Hz compared to the characteristic frequency response. The response may be increased at low frequencies by further reducing the resistance of the vent as shown by the 2.5E9 (Pa·s/m^3) Resistance External plot in FIG. 14. In this final example the frequency response increases by 3 dB at approximately 200 Hz compared to the characteristic frequency response. In some implementations, the balanced armature receiver includes a barometric vent from the back volume directly to the exterior of the housing and another barometric vent between the back volume and the front volume, or a barometric vent between the back volume and the nozzle.

In RIC or other voice-amplified devices, venting between the back volume and the front volume is often preferred over venting the back volume directly to the exterior of the housing where microphones can detect sound and cause unwanted feedback. Thus when venting directly to the exterior of the housing in a voice-amplified device including microphones, it is desirable to provide a barometric relief vent having a high acoustic resistance to reduce unwanted sound leakage detectable by the microphones. The gas permeable barriers described herein can provide such high acoustic resistance and liquid impermeability at the same time.

In one implementation, one or more gas permeable barriers are configured and located so that the barometric relief causes an sound pressure level (SPL) deviation in the frequency response of less than 3 dB at 500 Hz compared to a characteristic frequency response of the balanced armature receiver in the absence of the barometric relief. In another implementation, one or more gas permeable barriers are configured and located so that the barometric relief causes a deviation in the frequency response of 3 dB at a frequency less than 200 Hz compared to a characteristic frequency response of the balanced armature receiver in the absence of the barometric relief. In yet another implementation, one or more permeable barriers are configured and located so that the barometric relief causes a deviation in the frequency response of 3 dB at a frequency less than 100 Hz compared to a characteristic frequency response of the balanced armature receiver in the absence of the barometric relief. In yet another implementation, one or more gas permeable barriers are configured and located so that the barometric relief causes a deviation in the frequency response of 3 dB at a frequency less than 50 Hz compared to a characteristic frequency response of the balanced armature receiver in the absence of the barometric relief.

While the disclosure and what is presently considered to be the best mode thereof has been described in a manner establishing possession and enabling those of ordinary skill in the art to make and use the same, it will be understood and appreciated that there are many equivalents to the representative embodiments described herein and that myriad modifications and variations may be made thereto without departing from the scope and spirit of the invention, which is to be limited not by the embodiments described but by the appended claims and their equivalents.

What is claimed is:

1. A balanced armature receiver comprising:

a housing;

a diaphragm disposed in the housing and separating an interior of the housing into a front volume and a back volume;

a sound port between the front volume and an exterior of the housing;

a motor disposed in the housing and comprising a coil located proximate an armature having a free-end portion movably located between permanent magnets retained by a yoke, the free-end portion of the armature coupled to a movable portion of the diaphragm;

a gas permeable barrier located on a portion of the receiver defining the back volume, the gas permeable barrier substantially impermeable to liquid infiltration, wherein the gas permeable barrier provides barometric relief for the back volume of the housing.

2. The balanced armature receiver of claim 1, wherein the gas permeable barrier has a specific acoustic impedance of 5,000 MKS Rayl or greater and the gas permeable barrier forms a barometric relief vent in the back volume.

3. The balanced armature receiver of claim 2, wherein the barometric relief vent has an acoustic resistance of between 5E9 Pa·s/m^3 and 1E13 Pa·s/m^3.

4. The balanced armature receiver of claim 3, wherein the barometric relief vent comprises an aperture having a diameter between 0.1 mm and 1.0 mm.

5. The balanced armature receiver of claim 1, wherein the gas permeable barrier comprises an oleophobic coating.

6. The balanced armature receiver of claim 1, the housing comprises a nozzle including a sound tube portion and a base portion, the base portion coupled to a wall portion defining the back volume, the nozzle acoustically coupled to the sound port, wherein the gas permeable barrier is disposed on the wall portion defining the back volume.

7. The balanced armature receiver of claim 6, wherein the gas permeable barrier is located within the nozzle.

8. The balanced armature receiver of claim 7, wherein the gas permeable barrier is retained between the wall portion defining the back volume and the base portion of the nozzle.

9. The balanced armature receiver of claim 1, wherein the gas permeable barrier is located within the housing and provides barometric relief directly to the exterior of the housing.

10. The balanced armature receiver of claim 9, wherein the gas permeable barrier is mechanically clamped to an inner surface of the housing.

11. The balanced armature receiver of claim 1, wherein the gas permeable barrier is disposed on a portion of the diaphragm.

12. The balanced armature receiver of claim 11, wherein the gas permeable barrier is clamped between a portion of the diaphragm and the housing.

13. The balanced armature receiver of claim 11, wherein the diaphragm comprises a paddle movably coupled to a frame by a flexible membrane, the flexible membrane comprising the gas permeable barrier.

14. The balanced armature receiver of claim 11, wherein the diaphragm comprises a paddle movably coupled to a frame by a flexible membrane, the paddle comprising the gas permeable barrier.

15. The balanced armature receiver of claim 1 further comprising a terminal fastened to the housing, the terminal including contacts electrically coupled to the coil, wherein the terminal is co-located with the gas permeable barrier.

16. The balanced armature receiver of claim 1, wherein the barometric relief causes a deviation in a frequency response of the balanced armature receiver of 3 dB at a frequency less than 200 Hz compared to a characteristic frequency response of the balanced armature receiver in the absence of the barometric relief.

17. The balanced armature receiver of claim 1, wherein the barometric relief causes a deviation in a frequency response of the balanced armature receiver of 3 dB at a frequency less than 100 Hz compared to a characteristic frequency response of the balanced armature receiver in the absence of the barometric relief.

18. The balanced armature receiver of claim 1, wherein the barometric relief causes a deviation in a frequency response of the balanced armature receiver of 3 dB at a frequency less than 50 Hz compared to a characteristic frequency response of the balanced armature receiver in the absence of the barometric relief.

19. The balanced armature receiver of claim 1, wherein the gas permeable barrier forms a barometric relief vent with an acoustic resistance of 5E9 Pa·s/m^3 or greater and comprising a material with a specific acoustic impedance of at least 5,000 MKS Rayl.

20. The balanced armature receiver of claim 9, wherein the gas permeable barrier is secured to an inner surface of the housing with a glue.

* * * * *